US006871801B2

(12) United States Patent
Kienzler et al.

(10) Patent No.: US 6,871,801 B2
(45) Date of Patent: Mar. 29, 2005

(54) INJECTION NOZZLE

(75) Inventors: Dieter Kienzler, Leonberg (DE); Patrick Mattes, Stuttgart (DE); Wolfgang Stoecklein, Stuttgart (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 49 days.

(21) Appl. No.: 10/275,885

(22) PCT Filed: Mar. 9, 2002

(86) PCT No.: PCT/DE02/00847

§ 371 (c)(1),
(2), (4) Date: Apr. 7, 2003

(87) PCT Pub. No.: WO02/073023

PCT Pub. Date: Sep. 19, 2002

(65) Prior Publication Data

US 2003/0168526 A1 Sep. 11, 2003

(30) Foreign Application Priority Data

Mar. 12, 2001 (DE) ..... 101 11 783

(51) Int. Cl.[7] ..... F02M 59/00

(52) U.S. Cl. ..... 239/533.2; 239/533.4; 239/533.11; 239/88; 239/96; 239/533.9

(58) Field of Search ..... 239/533.2, 533.3, 239/533.4, 533.11, 88, 91, 92, 93, 95, 89; 123/447, 467, 496

(56) References Cited

U.S. PATENT DOCUMENTS

| | | | | | |
|---|---|---|---|---|---|
| 4,168,804 | A | * | 9/1979 | Hofmann | 239/533.11 |
| 5,779,149 | A | * | 7/1998 | Hayes, Jr. | 239/124 |
| 6,726,121 | B1 | * | 4/2004 | Kienzler et al. | 239/96 |

FOREIGN PATENT DOCUMENTS

| | | | |
|---|---|---|---|
| DE | 19634105 | * | 1/1998 |
| DE | 19936667 | * | 2/2001 |
| DE | 19936669 | * | 2/2001 |
| EP | 0393590 | * | 10/1990 |
| EP | 0807757 | * | 11/1997 |

* cited by examiner

*Primary Examiner*—Dinh Q. Nguyen
(74) *Attorney, Agent, or Firm*—Ronald E. Greigg

(57) ABSTRACT

An injection nozzle has a nozzle body, a nozzle needle that is supported displaceably in the nozzle body, a control chamber that communicates with a fluid inlet and a fluid outlet, and a valve element that can open and close the fluid outlet. The control chamber is laterally defined by a displaceable ring which rests on the nozzle needle, and a closing spring presses the ring against the nozzle needle in fluid-tight fashion.

22 Claims, 9 Drawing Sheets

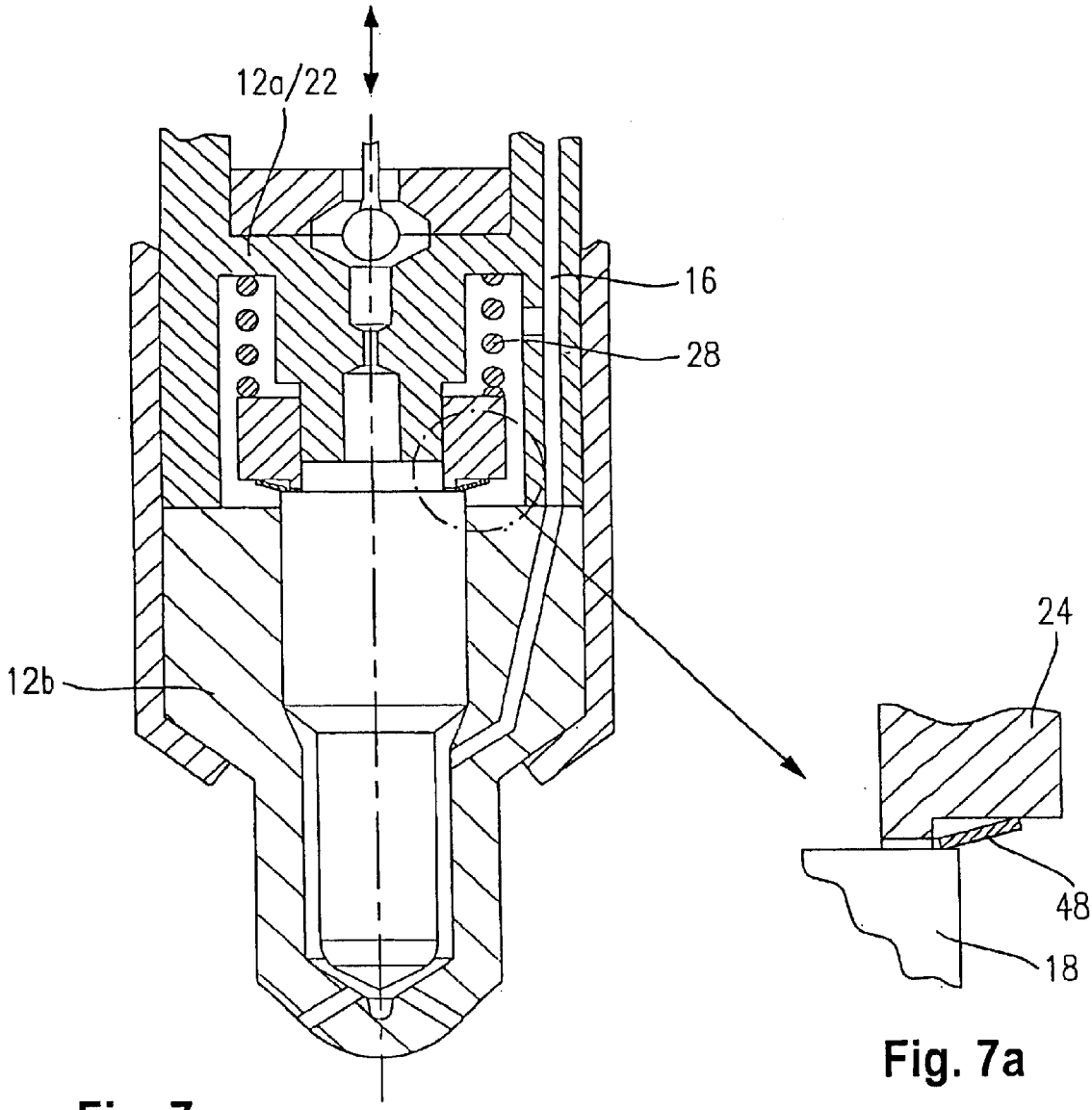
Fig. 7
Fig. 7a
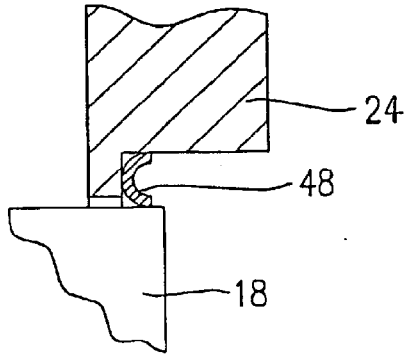
Fig. 7b

INJECTION NOZZLE

CROSS-REFERENCE TO RELATED APPLICATIONS

This application is a 35 USC 371 application of PCT/DE 02/00847 filed on Mar. 9, 2002.

BACKGROUND OF THE INVENTION

1. Field of the Invention

The invention relates to an injection nozzle, having a nozzle body, a nozzle needle that is supported displaceably in the nozzle body, a control chamber that is in communication with a fluid inlet line and a fluid outlet line, and a control element that can open and close the fluid outlet line.

2. Description of the Prior Art

From the prior art, injection nozzles of the above type are known that are used in common rail injection systems. For closing the needle, they have a closing spring, which is located in the control chamber. The size of the spring thus determines the control chamber volume. Since for good closure of the needle, the spring should have the greatest possible stiffness and is thus relatively large, the control chamber volume also becomes comparatively great. This makes the injector sluggish, and the quantity and instant of injection cannot be defined exactly.

One object of the invention is therefore to refine an injection nozzle of the type defined at the outset in such a way that the dimensions of the closing spring can be selected freely, independently of the control chamber volume and independently of the control piston diameter that is important for the needle speed. Another object of the invention is for the nozzle needle guide no longer to have to assume any sealing function.

SUMMARY OF THE INVENTION

The injection nozzle has the advantage that the control chamber volume can be made quite small, and as a result a rapid response behavior of the nozzle is achieved. High needle speeds can be attained, since the diameter of the control piston can be defined freely. The closing spring makes good closing performance of the nozzle possible. Moreover, the communication between the ring and the nozzle needle is fluid-tight. Thus the nozzle needle guide no longer has any sealing function, which makes the demand for the quality of the guidance less stringent.

In a preferred embodiment of the invention, the fluid inlet line has a first throttle element, and the fluid outlet line has a second throttle element. By dimensioning the two throttle elements with reference to the control piston diameter of the valve body, the needle speed can thus be defined in a simple way.

BRIEF DESCRIPTION OF THE DRAWINGS

The invention is described below in conjunction in the accompanying drawings, in which:

FIG. 7, in a sectional view, an injection nozzle of the invention in a seventh embodiment, FIG. 7*a* shows a detail of one portion thereof and FIG. 7*b* shows an alternative design for the portion shown in FIG. 7*a*;

DESCRIPTION OF THE PREFERRED EMBODIMENTS

Figure 1:
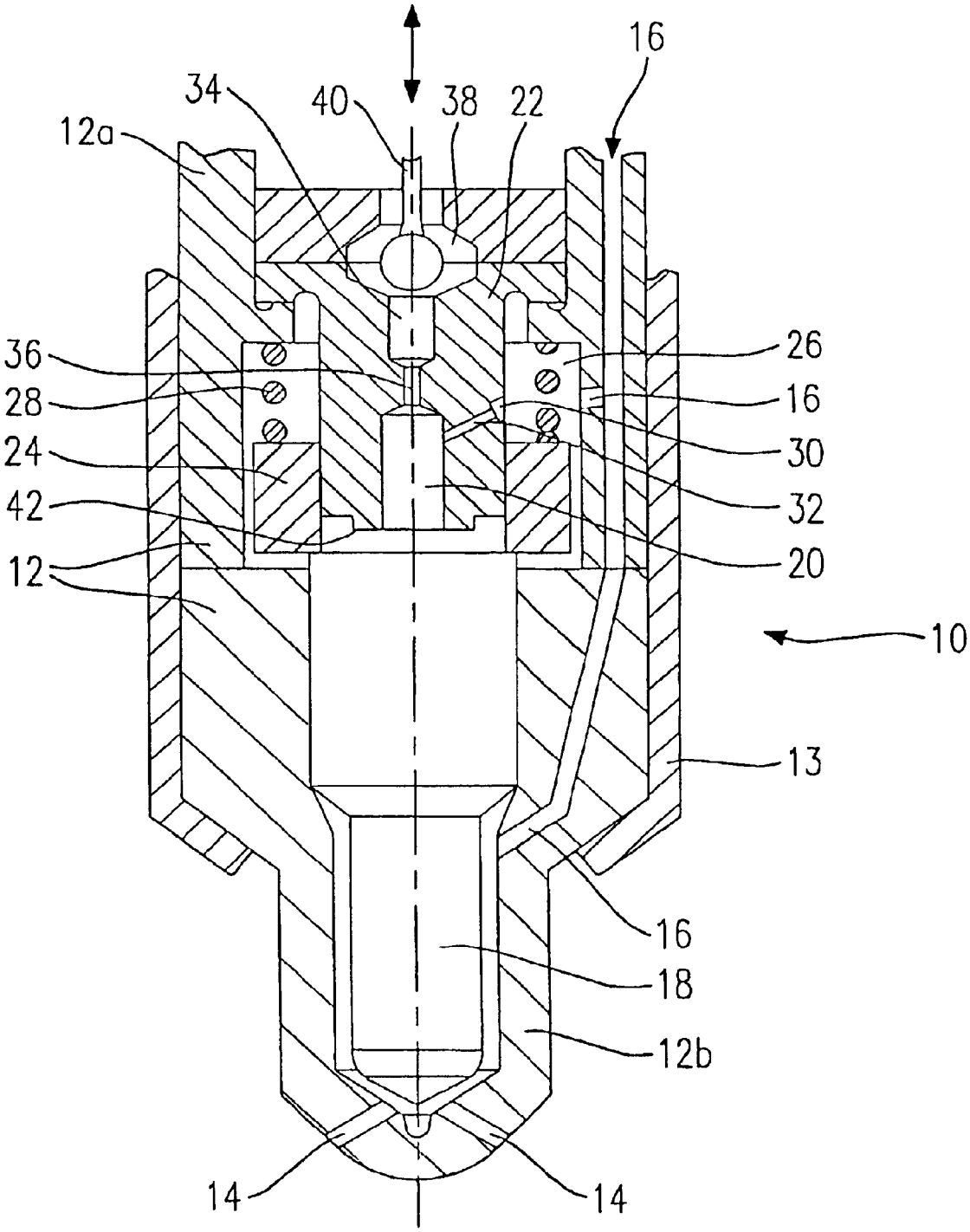
FIG. 1 is a sectional view of an injection nozzle of the invention in a first embodiment.

In FIG. 1, an injection nozzle is shown in accordance with a first embodiment of the invention. The injection nozzle 10 has a nozzle body 12, which here is constructed of a plurality of portions 12*a*, 12*b*, which are held firmly together by a bracing element 13. The nozzle body 12 is provided with nozzle openings 14, through which fuel can be injected into the cylinder of an internal combustion engine. A fuel conduit 16 leads to the nozzle openings.

In the nozzle body 12, a nozzle needle 18 is mounted displaceably in such a way that from an outset position, in which the nozzle openings 14 are closed, it can be put into an injection position, in which the nozzle openings are opened.

On the side of the nozzle needle 18 remote from the nozzle openings 14, a control chamber 20 is formed, one face end of which is formed by the back side of the nozzle needle 18, and the other face end of which is formed by a valve block 22. The circumferential wall of the control chamber 20 is formed by a ring 24, which is disposed in a sealed way displaceably on the outer wall of the valve block 22 and which rests on the flat back side of the nozzle needle 18. This makes a tolerance compensation possible between the ring 24 and the nozzle needle 18.

A closing spring 28 for the nozzle needle 18 is disposed in a reservoir 26 between the nozzle body 12 and the valve block 22. The closing spring 28 is braced on the ring 24, so that the ring is pressed against the nozzle needle 18 with a predetermined force. In this way, on the one hand a fluid-tight contact of the ring 24 with the nozzle needle 18 is obtained, and on the other, the nozzle needle is urged into its outset position.

The control chamber has a fluid inlet 30, which branches off from the fuel conduit and is provided with an inlet throttle 32. The control chamber 20 also has a fluid outlet 34, which is provided with an outlet throttle 36. The cross section of the outlet throttle 36 is greater than the cross section of the inlet throttle 32.

The fluid outlet 34 discharges into a valve chamber 38, in which a valve element 40 is disposed. The valve element 40 can be moved between a position in which the fluid outlet 34 is closed and a position in which the fluid outlet is opened. Arbitrary means known to one skilled in the art, such as a piezoelectric actuators, can be used to move the valve element 40.

In the outset state, that is, when no fuel is to be injected, the valve element 40 is in the closed position. The fuel is thus dammed up in the control chamber 20, so that the fuel pressure prevails there. Since the cross section of the back side of the nozzle needle 18 is larger than the cross section of the nozzle needle in the region of the nozzle openings 14, the force generated in the control chamber 20, which urges the nozzle needle into the closed position, is greater than the force that is generated at the opposite end of the nozzle needle and that urges the nozzle needle into the opened position. The force of the closing spring 28 is added to this difference. The nozzle needle accordingly remains in the closed position.

When fuel is to be injected, the fluid outlet 34 is uncovered by the valve element 40. Since because of the cross-sectional ratios between the outlet throttle and the inlet throttle the pressure in the control chamber 20 now drops, it is attained that as a result of the fuel pressure acting on the tip of the nozzle needle 18, the nozzle needle lifts from the nozzle openings 40 and is displaced into the opened position. The displacement is limited by the contact of the back side of the nozzle needle 18 with a protrusion 42, acting as a stop, of the valve block 22.

Upon the transition of the nozzle needle 18 to the opened position, the ring 24 is pushed back by the nozzle needle; the sealed contact between the ring and the nozzle needle is maintained. The fluid volume positively displaced in the region of the closing spring 28 upon displacement of the ring 24 can bypass the ring and flow into the lower part of the reservoir 26. Since the pressure in the control chamber 20 is never greater than the pressure in the surrounding parts of the nozzle, the ring 24 is not lifted from the nozzle needle 18. This embodiment offers the advantage that with respect to the fluid, a tight seal between the nozzle needle 18 and the ring 24 is achieved. This in turn lessens the demands made of fluid tightness of the guidance of the nozzle needle 18 in the nozzle body 12, thus simplifying the structure of the injection nozzle. Moreover, the size of the closing spring can be selected independently of the control piston diameter and the control chamber volume, which makes it easier to dimension the injector.

Figure 2:
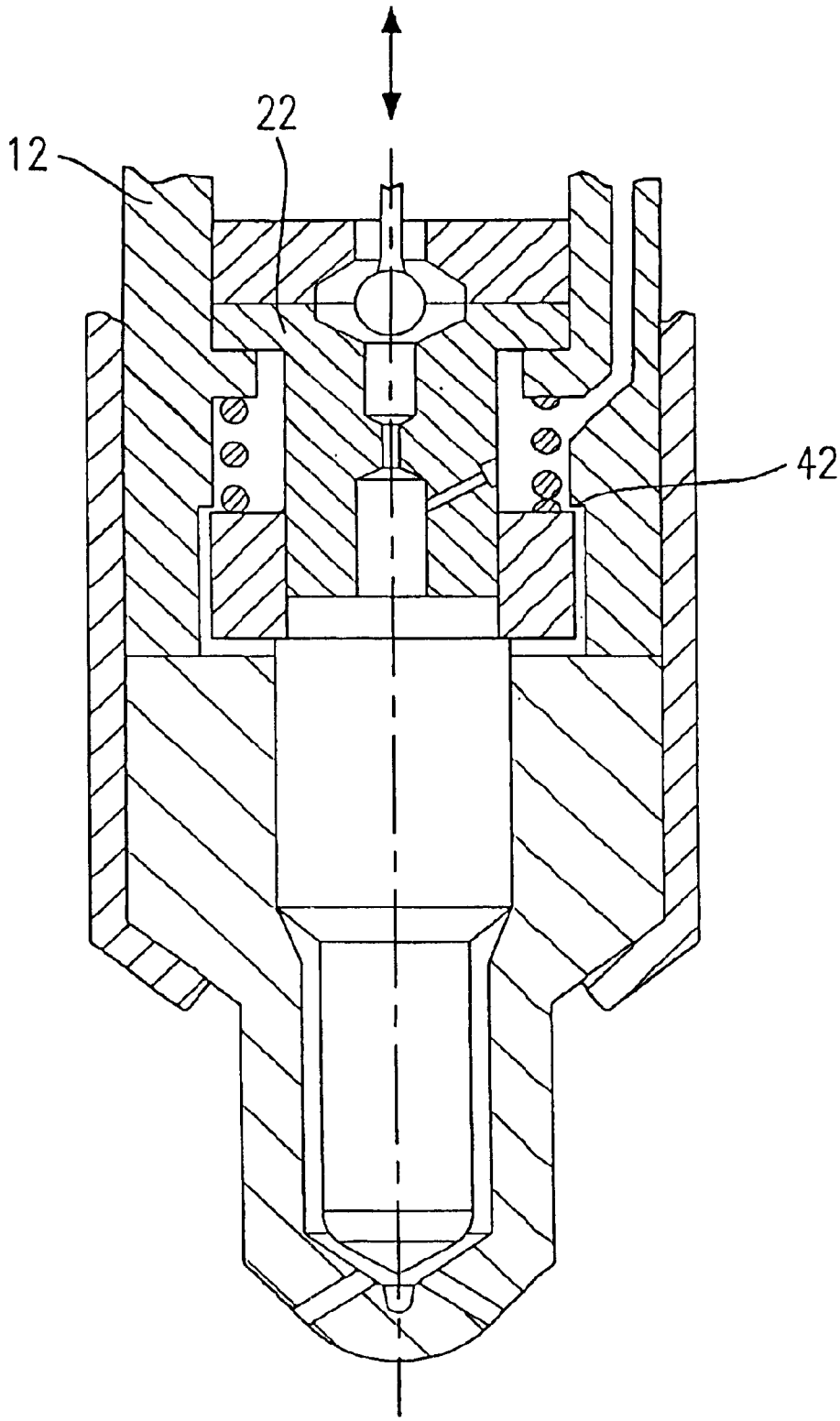
FIG. 2 is a sectional view of an injection nozzle of the invention in a second embodiment.

In FIG. 2, an injection nozzle is shown in accordance with a second embodiment of the invention. To the extent that components known from the first embodiment are used in this embodiment, the same reference numerals are employed. In terms of their function, reference is made to the description above.

In a distinction from the first embodiment, in which the stop for the nozzle needle is seated on the valve block 22, the nozzle body 12 here has the protrusion 42, which limits the displacement of the ring 24 and thus of the nozzle needle 18. This has the advantage that the stop position of the nozzle needle relative to the nozzle body is defined precisely and does not also depend on the location of the valve block relative to the nozzle body.

Figure 3:
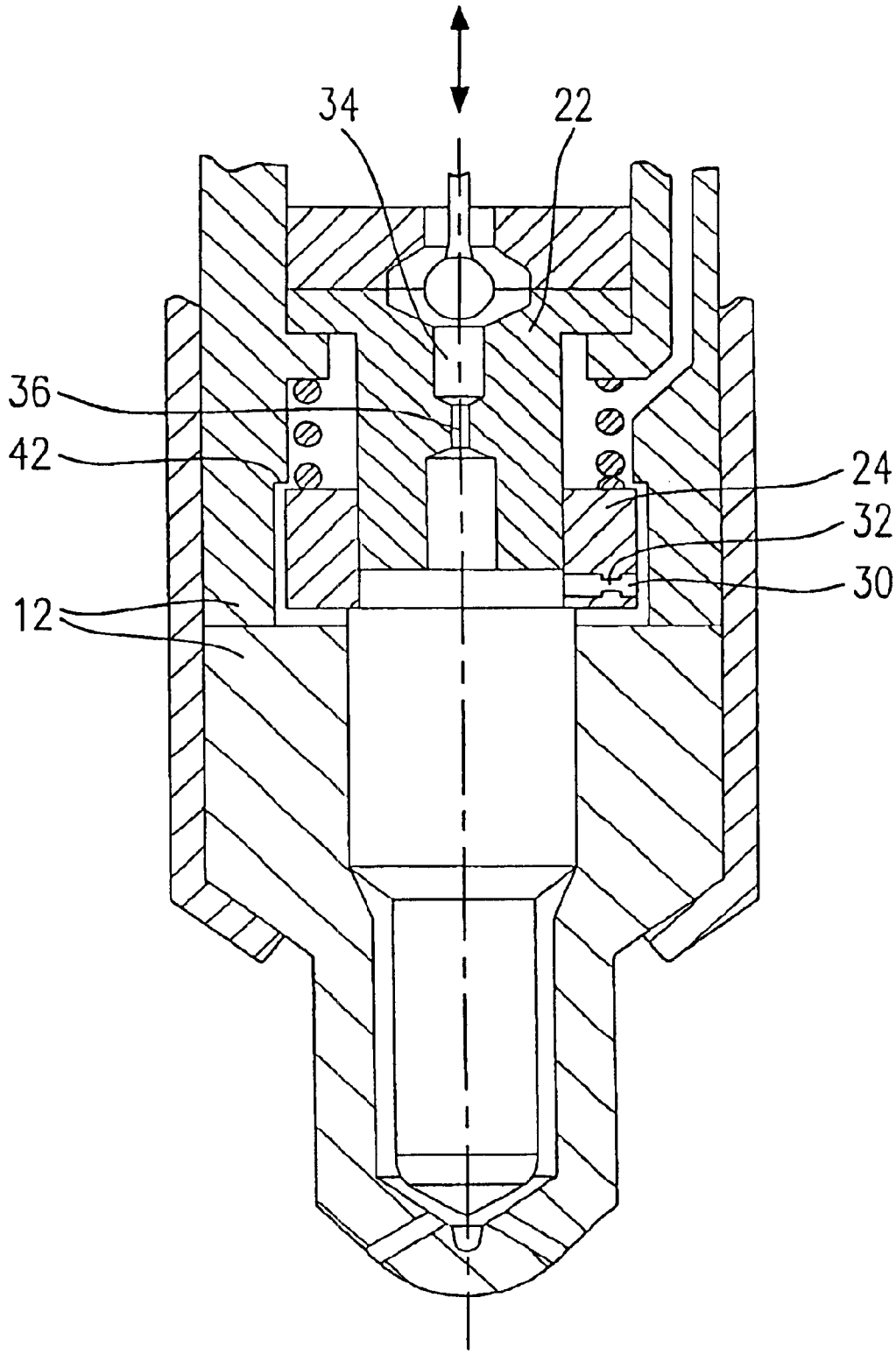
FIG. 3 is a sectional view of an injection nozzle of the invention in a third embodiment.

In FIG. 3, an injection nozzle is shown in a third embodiment of the invention. For components known from the above embodiments, the same reference numerals are used, and reference is made to the above descriptions.

In a distinction from the first embodiment, the fluid inlet 30 with the inlet throttle 32 is located here in the ring 24. The inlet throttle 32 and outlet throttle 36 are located in different components, which offers the capability of also combining different versions of the two components, that is, the ring and the valve block.

Figure 4:
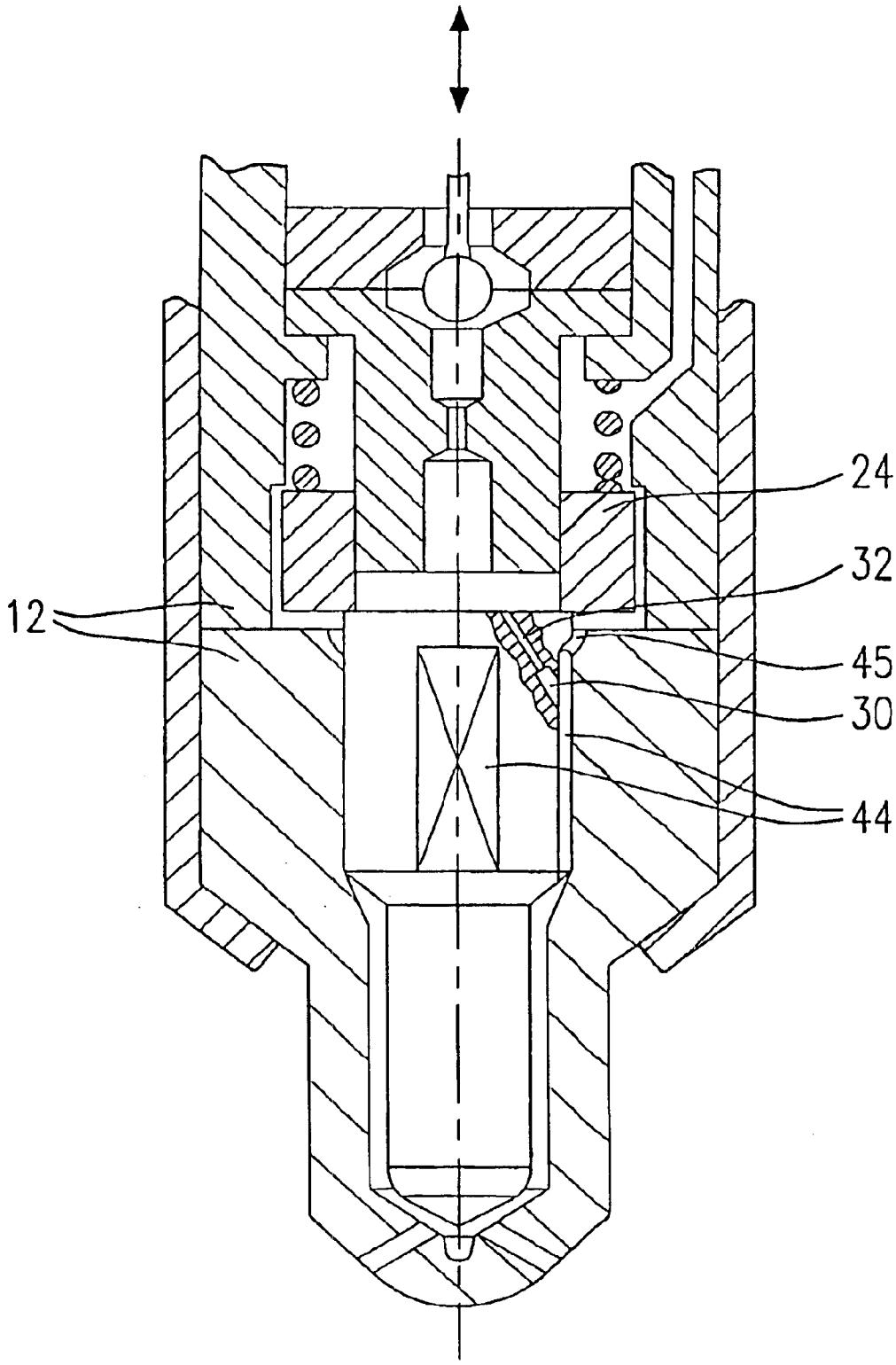
FIG. 4 is a sectional view of an injection nozzle of the invention in a fourth embodiment.

In FIG. 4, an injection nozzle is shown in a fourth embodiment of the invention. For components known from the above embodiments, the same reference numerals are used, and reference is made to the above descriptions.

In a distinction from the first and second embodiments, the fuel delivery to the nozzle needle 18 takes place here via inflow chambers 44, which are ground into the nozzle needle. To assure the sealing function between the nozzle needle 18 and the sealing ring 24, the inflow chambers 44 can be embodied such that they do not extend over the entire guidance height of the needle. In this embodiment, the inlet throttle 34 is accommodated in the nozzle needle. A first chamfer 45 facilitates the inflow of fuel to the fluid inlet 30. Because of the location of the fluid inlet and fluid outlet in the components, that is, the nozzle needle and the valve block, the possibility exists here of combining various embodiments of these two components.

Figure 5:
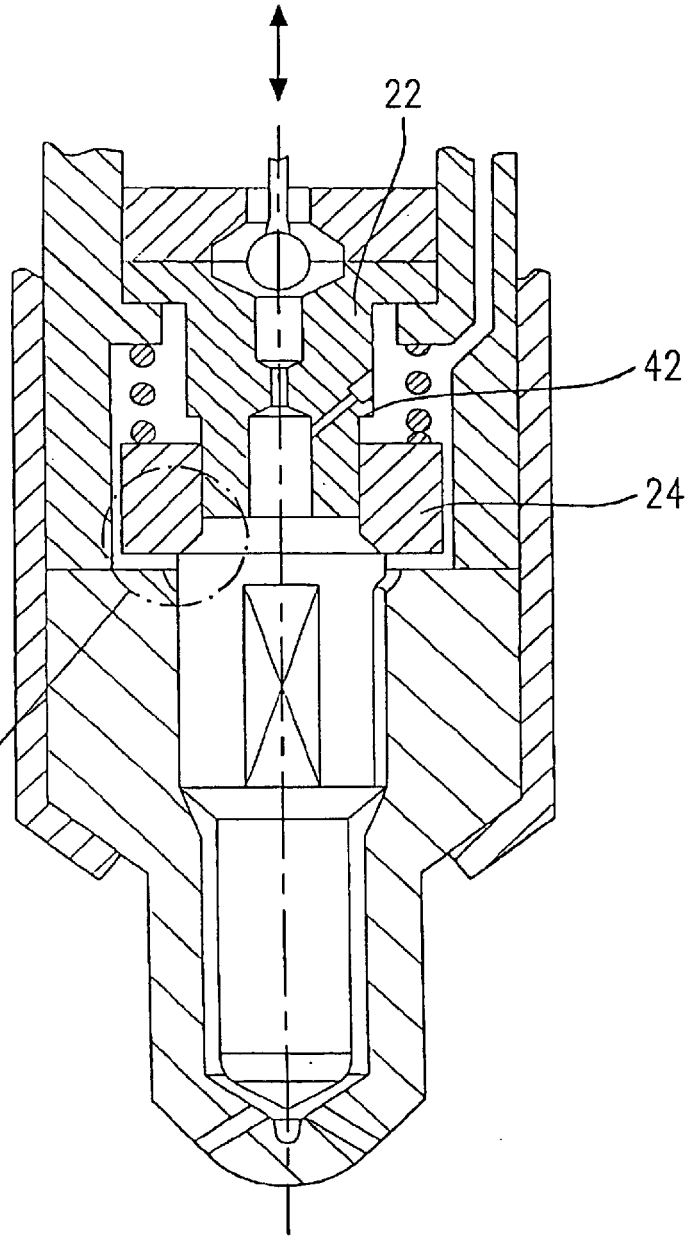
FIG. 5 is a sectional view of an injection nozzle of the invention in a fifth embodiment.
Figure 5A:
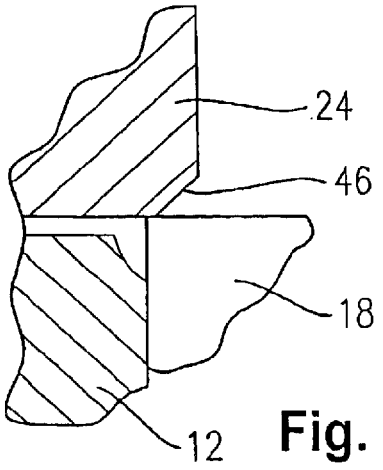
FIG. 5*a* shows a detail of one portion thereof.

In FIG. 5, an injection nozzle is shown in a fifth embodiment of the invention. For components known from the above embodiments, the same reference numerals are used, and reference is made to the above descriptions.

The ring 24 is provided here with a second chamfer 46, so as to attain better sealing by means of a reduced bearing surface area at the flat seat between the ring 24 and the nozzle needle 18.

Figure 6:
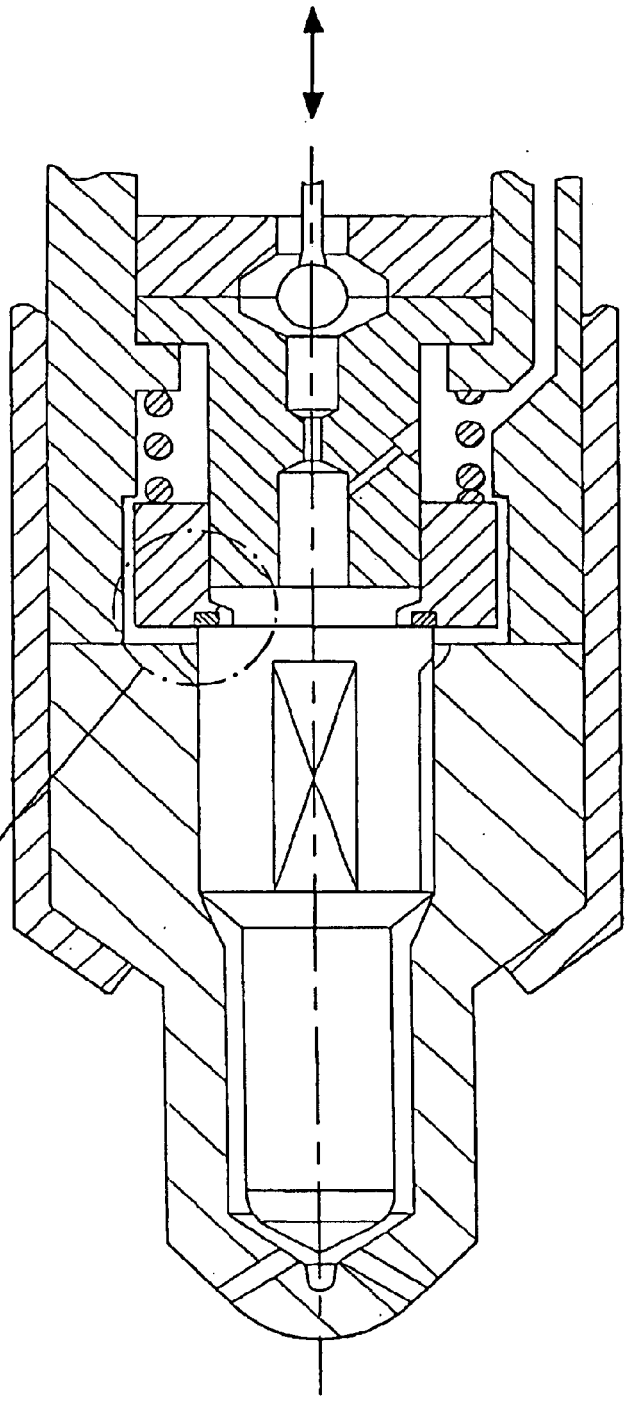
FIG. 6 is a sectional view of an injection nozzle of the invention in a sixth embodiment.
Figure 6A:
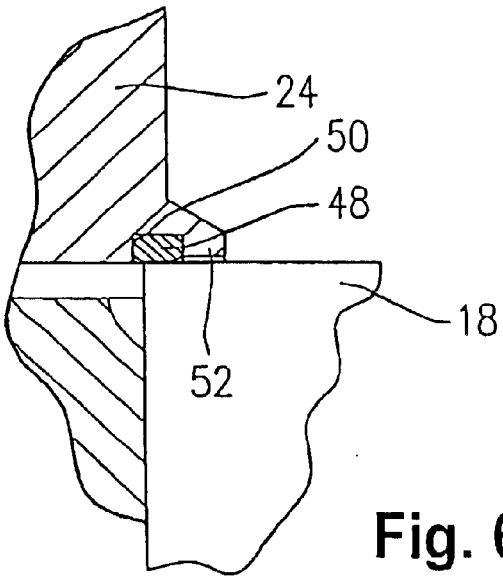
FIG. 6*a* shows a detail of one portion thereof.

In FIG. 6, an injection nozzle is shown in a sixth embodiment of the invention. For components known from the above embodiments, the same reference numerals are used, and reference is made to the above descriptions.

In this embodiment, in the area contact between the ring and the nozzle needle, a sealing element 48 is inserted. This achieves improved sealing off of the control chamber 20 in the region of the connection between the ring and the nozzle needle. The nozzle needle is provided here with an annular groove 50, since by means of this annular groove, the sealing element 48 can be supported securely. The transmission of force between the nozzle needle 18 and the ring 24 is effected via an annular protrusion 52.

In a further preferred embodiment, as shown in FIGS. 7, 7*a*, and 7*b*, the sealing element 48 is a sealing spring. A cup spring (FIG. 7*a*) is especially preferred here. This is particularly advantageous since even if a ring 24 is not seated uniformly on the nozzle needle 18, the cup spring 48 enables complete sealing between the ring and the nozzle needle. The initial tension of the cup spring 48 should always be less than the tension of the closing spring 28, so that the ring 24 will always rest on the nozzle needle 18.

If the part 12*a* of the nozzle body and the valve block 22 are embodied in one piece (FIG. 7), the assembly of the injection nozzle is simplified and the precision of production of the entire nozzle is improved.

Figure 8:
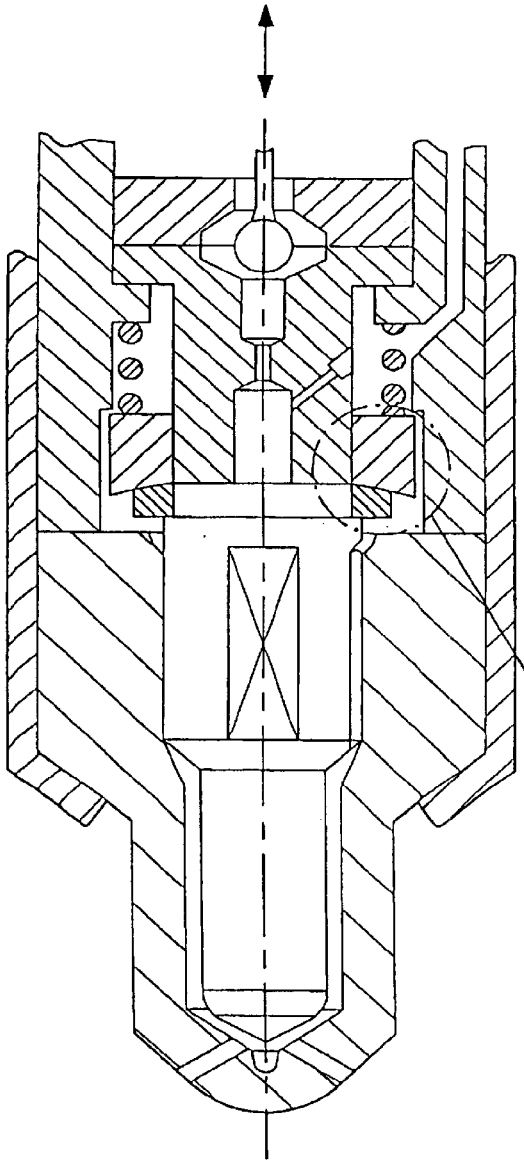
FIG. 8 is a sectional view of an injection nozzle of the invention in an eighth embodiment.
Figure 8A:
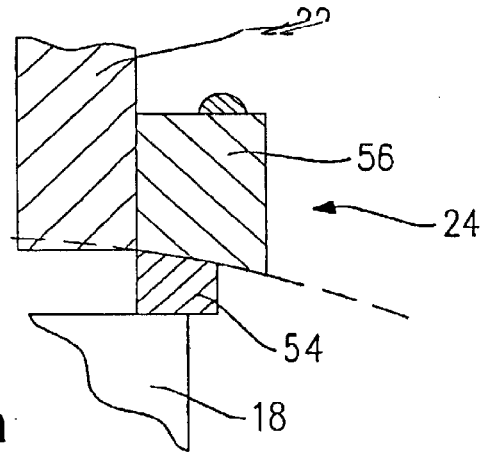
FIG. 8*a* shows a detail of one portion thereof.

In FIG. 8, an injection nozzle is shown in an eighth embodiment of the invention. For components known from the above embodiments, the same reference numerals are used, and reference is made to the above descriptions.

In this embodiment, the ring 24 comprises a first annular portion 54 and a second annular portion 56. The boundary face between the first and second annular portions is a spherical-segment face. As a consequence of the assembly of the injection nozzle, the central axis of the valve block 22 may not precisely match the central axis of the nozzle needle 18; that is, the two axes may be inclined somewhat relative to one another. Since the ring 24 rests on the outer wall of the valve block, in that case the central axis of the ring also deviates from the central axis of the nozzle needle, making a complete seal between the ring and the nozzle needle impossible. If the ring is constructed of two annular portions, the central axis of the first annular portion 54 then matches the central axis of the nozzle needle, and the central axis of the second annular portion 56 matches the central axis of the valve block. The first and second annular portions with the spherical-segment face have complementary sliding faces so that they can move relative to one another. The common boundary face furthermore makes the sealing between the two annular portions possible. Since the central axes of the nozzle needle and the first annular portion match, a complete seal between the ring 24 and the nozzle needle 18 is achieved.

Figure 9:
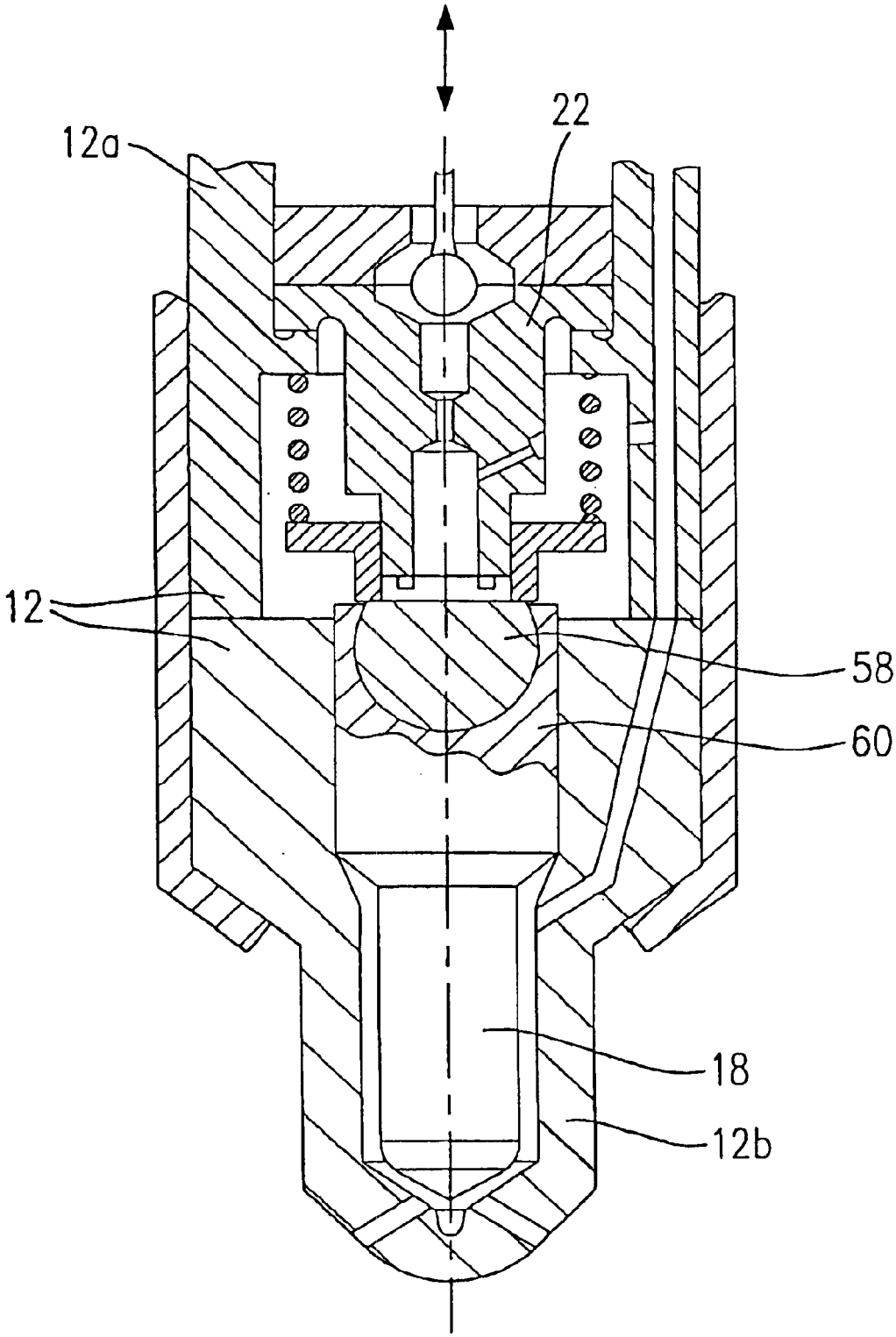
FIG. 9 is a sectional view of an injection nozzle of the invention in a ninth embodiment.

In FIG. 9, a further preferred embodiment of the injection nozzle is shown. Here, the nozzle needle 18 comprises a first nozzle needle part 58 and a second nozzle needle part 60. In a particularly simple way, this makes it possible to compensate for a deviation of axis between the valve block 22 and the nozzle needle 18. To that end, the first nozzle needle part is advantageously embodied such that it forms a spherical segment and rests with positive engagement in the second nozzle needle part. An especially easily achieved compensation for the deviation in axis is thus realized.

The foregoing relates to preferred exemplary embodiments of the invention, it being understood that other variants and embodiments thereof are possible within the spirit and scope of the invention, the latter being defined by the appended claims.

We claim:

1. An injection nozzle, comprising a nozzle body (12), a nozzle needle (18) that is displaceably supported in the nozzle body, a control chamber (20) that communicates with a fluid inlet (30) and a fluid outlet (34), a valve element (40) that can open and close the fluid outlet (34), the control chamber being defined laterally by a displaceable ring (24), which ring rests on the nozzle needle, and a closing spring (28) presses the displaceable ring (24) against the nozzle needle in fluid-tight fashion.

2. The injection nozzle of claim 1, wherein the fluid inlet (30) comprises an inlet throttle (32), and the fluid outlet (34) comprising an outlet throttle (36).

3. The injection nozzle of claim 2, wherein the inlet throttle and the outlet throttle (32, 36) are accommodated in a valve block (22).

4. The injection nozzle of claim 2, wherein the inlet throttle (32) is accommodated in the ring (24).

5. The injection nozzle of claim 2, wherein the inlet throttle (32) is accommodated in the nozzle needle (18).

6. The injection nozzle of claim 1, wherein the inlet throttle and the outlet throttle (32, 36) are accommodated in a valve block (22).

7. The injection nozzle of claim 1, wherein the inlet throttle (32) is accommodated in the ring (24).

8. The injection nozzle of claim 1, wherein the inlet throttle (32) is accommodated in the nozzle needle (18).

9. The injection nozzle of claim 8, wherein the nozzle body (12) has a first chamfer (45).

10. The injection nozzle of claim 9, wherein the ring (24) has a second chamfer (46), in the bearing region between the ring and the nozzle needle (18).

11. The injection nozzle of claim 1, wherein in the control chamber (20), a protrusion (42) on which the nozzle needle (18) can rest is embodied on the valve block (22).

12. The injection nozzle of claim 11, wherein the protrusion (42) is embodied on the nozzle body (12), and that the ring (24) can rest on the protrusion.

13. The injection nozzle of claim 1, wherein the injection nozzle has a sealing element (48), in the bearing region between the ring (24) and the nozzle needle (18).

14. The injection nozzle of claim 13, wherein the sealing element (48) between the ring (24) and the nozzle needle (18) is a sealing ring.

15. The injection nozzle of claim 14, wherein the sealing ring (48) is supported in an annular groove (50).

16. The injection nozzle of claim 13, wherein the sealing element (48) between the ring (24) and the nozzle needle (18) is a sealing spring.

17. The injection nozzle of claim 16, wherein the sealing spring (48) is a cup spring.

18. The injection nozzle of claim 1, wherein the ring (24) has a first annular portion (54) and a second annular portion (56).

19. The injection nozzle of claim 18, wherein further comprising a spherical-segment boundary face between the first and second annular portions (54, 56).

20. The injection nozzle of claim 1, wherein the nozzle needle (18) comprises a first nozzle needle part (58) and a second nozzle needle part (60).

21. The injection nozzle of claim 20, wherein the first nozzle needle part (58) is embodied as a spherical segment and rests with positive engagement in the second nozzle needle part (60).

22. The injection nozzle of claim 1, wherein a portion **(12*a*) of the nozzle body and the valve block (22)** are embodied in one piece.

* * * * *